United States Patent [19]

Roth

[11] 4,223,928

[45] Sep. 23, 1980

[54] WINDOW HARDWARE

[75] Inventor: Ernst Roth, Wilnsdorf, Fed. Rep. of Germany

[73] Assignee: Siegenia-Frank KG, Siegen, Fed. Rep. of Germany

[21] Appl. No.: 9,056

[22] Filed: Feb. 5, 1979

[30] Foreign Application Priority Data

Feb. 14, 1978 [DE] Fed. Rep. of Germany ... 7804212[U]

[51] Int. Cl.[2] ..... E05C 1/06

[52] U.S. Cl. ..... 292/157; 49/394

[58] Field of Search ..... 292/244, 157, 300, 302; 49/72, 371, 383–394

[56] References Cited

U.S. PATENT DOCUMENTS 3,212,140 10/1965 Byrka ..... 49/383 X 3,911,621 10/1975 McHeffey ..... 49/394 X

*Primary Examiner*—Richard E. Moore

*Attorney, Agent, or Firm*—Norman S. Blodgett; Gerry A. Blodgett

[57] ABSTRACT

Latch lock hardware for a window having a latch-lug that is insertable into a latch pocket in the casing for tilting purposes. The latch lock hardware comprises a pair of vertically-spaced cams located on the casing above the latch-pocket and a pair of vertically-spaced elements mounted on the window. The upper element is located beneath the upper cam to prevent removal of the window for a small tilting angle of the window and the lower element is located beneath the lower cam to prevent removal of the window for a relatively larger tilting angle of the window.

5 Claims, 4 Drawing Figures

12
18
17
11
16
15
14
13
12
1"
8'
19'
6
9
9
7
19"
8"
4
1
5'
5"
10
10
3
4
1'

WINDOW HARDWARE

BACKGROUND OF THE INVENTION

The present invention relates to a tip-latch lock-hardware for pivot-hung tip-wing casement windows and doors, etc. with a latch-pocket disposed at the locking side of the bottom corner of the fixed frame or casing, into which a latch-lug is axially insertable. The latch-lug is located at the bottom end of the slide plate at the side of the wing for the purposes of opening the window by tilting. A latch-pin is located on the slide plate at some distance above the latch-lug, for engaging (in the closed position of the wing) a latch-catch at the side of the frame. A lug with an upper transverse shoulder, also at some distance above the latch-pin, projects from the slide plate in the direction of the plane of the wing transversely of the direction of thrust of the slide plate. The shoulder is located above the latch-pocket and the latch-catch. A stationay cam is mounted on the stationary frame or casing, is offset from the longitudinal median plane of the latch-pocket towards the side of the room, and is positively undercut by the shoulder in the tipping position of the window wing.

Such a tip-latch lock-hardware fulfills, in the practical application of the pivot-hung tip-wing casement windows and doors, etc., three different functions. First, the wing in the closed position is fixed by the hardware to the stationary frame near its lower corner. Secondly, the hardware also forms the pivot support for the tilted opening of the wing in the region of the lower corner at the side of the locking mechanism. Finally, when the window is in tilted position, the present hardware also blocks the hardware of the slide plate, which is built into the wing for performing the different shift functions, against undesirable movement. This prevents a faulty shifting of the slide plate hardware when the window wing is tilted and, in particular, it protects against illegal entry.

Tip-latch lock-hardware to which the present invention is applied is shown in German OS-publications Nos. 22 43 916 and 22 59 884 and has proved most satisfactory in practical application in connection with pivot hung tip hardware of the applicant, and is illustrated and described, for example, in a pamphlet of SIEGENIA with the identification printing LM 4000 P 75 11/FR 10.

It is, therefore, an outstanding object of the invention to improve the tip-latch lock hardware of the prior art in such a way that the functional reliability of the shift lock or entry protection, that becomes operative when the wing is tilted open, works in an optimal manner.

Another object of the invention is to provide a spatial configuration for a tip-latch lock-hardware that is equally reliable on all tipping angles that occur in practice when the wing is swung open.

A further object of the present invention is to provide latch-hardware in which the blocking effect on the window is fully effective for a very small tipping angle and is totally retained over the entire tilt opening range occurring in normal practice.

With these and other objects in view, as will be apparent to those skilled in the art, the invention resides in the combination of parts set forth in the specification and covered by the claims appended hereto.

SUMMARY OF THE INVENTION

In general, the invention consists, on the window, of a latch pin at some distance underneath the latch engagement (latch catch) and a lug with a transverse shoulder above the latch engagement. A pair of stationary cams are located on the frame and are offset with respect to the longitudinal median of the latch-pocket towards the side of the room. When the wing is tilted, one cam lies above the shoulder and the other lies above the latch pin in such a way that, with small to medium tilting angle positions of the wing, the shoulder undercuts the cam that is assigned to it in a locking manner, when, in the case of medium to large tipping angle positions, the latch pin is lockingly set under the cam assigned to it.

More specifically, the latch-hardware of the present invention provides that in the medium tilting angle positions of the wing, the shoulders of the lug and latch pin are in operative connection with their respective assigned cams. In other words, there are provided two constructionally (as well as functionally) separate shift blocks or entry protection whose effective ranges partly overlap.

The latch-lug, the shoulder lug, and the latch-pin are mounted on a slide that is positively and detachably coupled to a connecting rod. This slide with the latch-lug, the shoulder, and the latch-pin is arranged symmetrically of a longitudinal median plane that runs parallel to the plane of the wing. The hardware is suitable for optional right-hand or left-hand stop pins. The latch-catch and the two cams sit on a common base plate and the cams are arranged on the base plate symmetrically of a transversal plane passing through the latch-catch, while the latch pocket is located on a second base plate which is likewise constructed symmetrically of a transversal plane. The transverse planes of both base plates extend normally towards the mounting plane of the fixed frame, but, on the other hand, are arranged at a right angle to each other.

BRIEF DESCRIPTION OF THE DRAWINGS

The character of the invention, however, may be best understood by reference to one of its structural forms, as illustrated by the accompanying drawings, in which.

DETAILED DESCRIPTION OF THE PREFERRED EMBODIMENT

Figure 2:
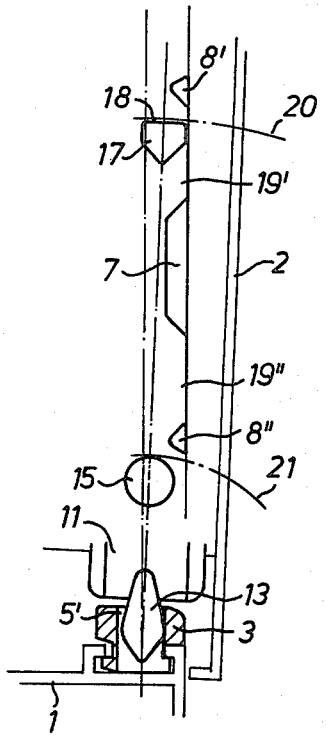
FIGS. 2–4 are diagrammatic operational view of the invention showing different tipping angles of the wing relative to the fixed frame.
Figure 3:
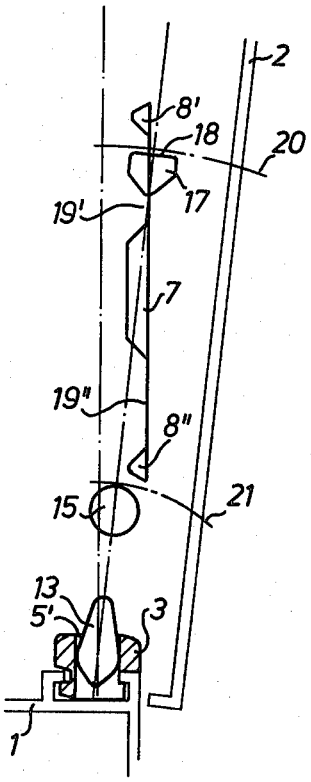
Figure 4:
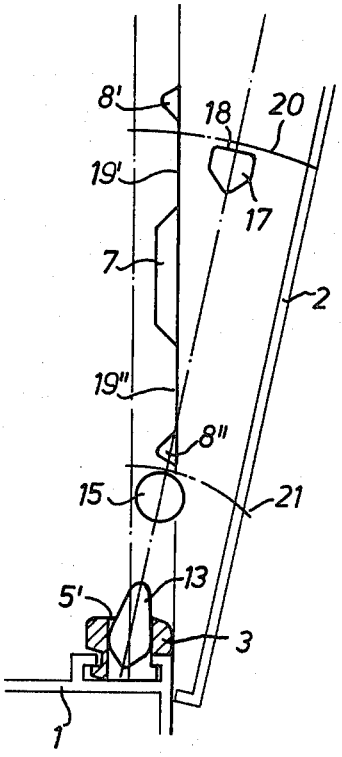

FIGS. 2–4 of the drawing show (for the sake of simplicity) only the lower, lock-side corner region of a pivot-hung window or door consisting of a stationary frame 1 and a wing 2 which is tiltable relative to this frame either around a vertical axis along one side or around a lower horizontal axis.

Figure 1:
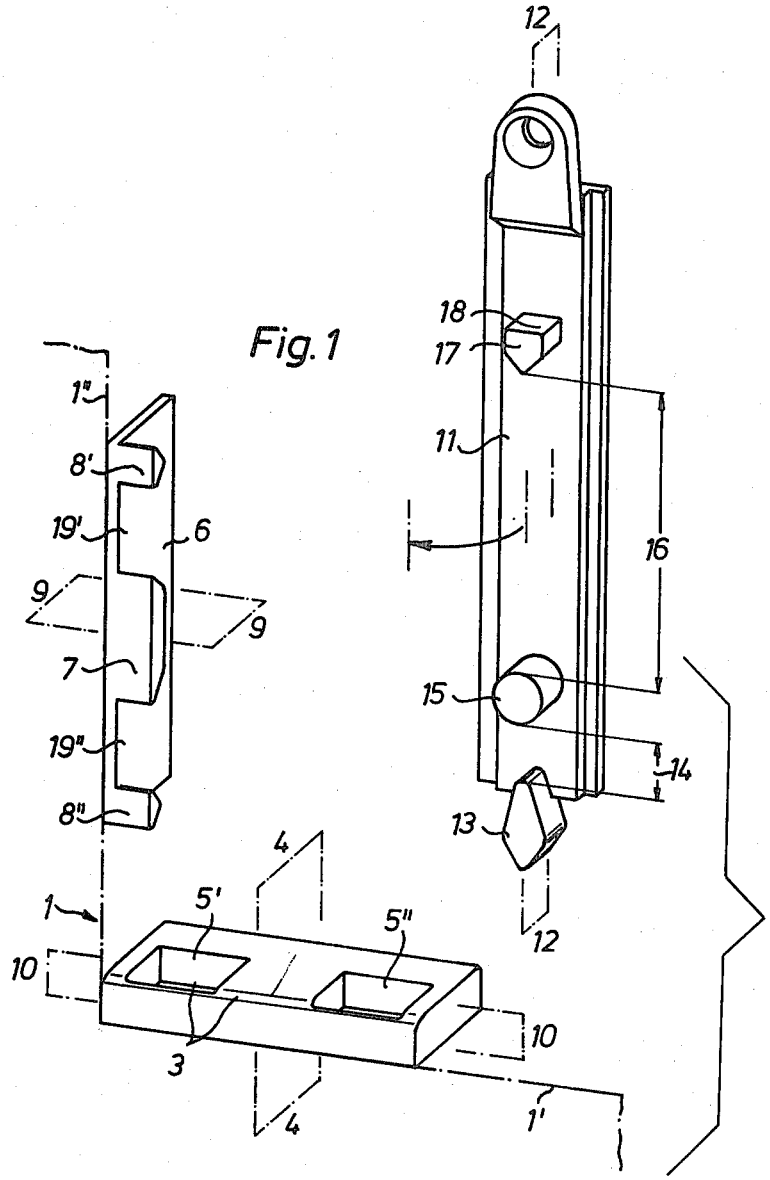
FIG. 1 is an exploded perspective of the invention.

In FIG. 1 the stationary frame 1 is merely indicated by dot-dash-lines to show how the frame-side parts of the tip-latch lock-hardware are installed in the region of the lock-side, lower frame corner to be able to carry out their function. At the lower, horizontal leg 1' of the stationary frame 1, there is stationarily mounted the tip-latch and run-up plate 3. This plate is designed to be symmetrical to a transverse plane 4—4 and which has latch pockets 5′ and 5″ located at both sides of plane 4—4.

On a right-hand mount of the window or door, the latch pocket 5′, as indicated in FIG. 1, is in operating position. In the case of a left-hand mount, the latch pocket 5′ is in operating position.

On the lock-side, vertical leg 1″ of the stationary frame 1, a latch catch 7, is mounted above base plate 6. Also, rigidly mounted at the base plate 6 are two cams 8′ and 8″ which lie at an identical distance above and below, respectively, the latch catch 7. Also, the base plate 6 with the latch catch 7 and the two cams 8′ and 8″ is formed symmetrically of a transverse plane 9—9, so that it is usable for right-hand as well as for left-hand stopping.

On a right-hand strike, the cam 8′ lies above the lock catch 7 and the cam 8″ below it, as shown in FIG. 1, while on a left-hand strike the cam 8″ is located above and the cam 8′ below the lock catch 7. Both the symmetry plane 4—4 of the tip-latch and run-up plate 3 and the symmetry plane 9—9 of the base plate 6 that carries the latch catch 7 and the two cams 8′ and 8″ extend essentially transversely of the plane of the stationary frame 1, as can be seen from FIG. 1. However, in the assembly state of the two hardware parts 3, 5′, 5″, and 6, 7, 8′, 8″ these transverse planes 4—4 and 9—9 are located at a right angle to one another as may likewise be seen from FIG. 1.

From the drawing, it can be further seen that the lock catch 7 and the two cams 8′, 8″ of the base plate 6 directly adjoin the room-side front face of the stationary frame 1, while the latch pockets 5′ and 5″ are at a selected spacing from this frame front. In other words, the catch 7 and the two cams 8′ and 8″ of the base plate 6 occupy, against the longitudinal medium plane 10—10 passing through the two latch pockets 5′ and 5″ of the tip latch and run-up plate 3, a position that is offset toward the side of the room.

At the lock-side, the vertical spar of the wing 2, at a surface that is essentially directed transversely of the plane of the wing, there is guided (in the range of the lower wing corner) a longitudinally-shiftable slide plate 11, which is either a part of a connecting rod or can be positively coupled with it. This slide plate 11 is arranged symmetrically of a longitudinal median plate 12—12 and is provided at its lower end with a somewhat drop-shaped latch-lug 13. More specifically, the shape of the lug 13 from the top toward the bottom, is first diverging and then converging.

At a spacing 14 underneath the latch-lug 13, is arranged a latch-pin 15 extending from the front face of the slide. At a spacing 16, a lug 17 is formed onto the slide plate 11 above the latch-pin 15. Lug 17 has an upper transversal shoulder 18. The ratio of the spacings 14 and 16 to each other is approximately 1:5, that is, the distance 16 of the lug 17 from the latch-pin 15 is substantially greater than the distance 14 of the latch-pin 15 from the latch-lug 13.

From FIGS. 2–4 of the drawings it can be seen that, when the latch-lug 13 of the slide plate 11 is pushed into the latch pocket 5′ or 5″ of the tip-latch and run-up plate 3, the wing can be opened around its lower, horizontal axis in tilting position. In this working position of the slide plate 11, the latch-pin 15 lies underneath the cam 8″ of the base plate 6 and, simultaneously, the lug 17 with its transverse shoulder 18 is located underneath the cam 8′ of the base plate 6. If the wing 2 is now opened in tilting position, after passing through merely a very small tilting angle of e.e. 1° to 2°, the lug 17 of the slide plate 11 goes underneath the cam 8′ as can be seen from FIG. 2. Up to a medium tilting angle of e.g. about 7°, the transverse shoulder 18 of the lug 17 reliably cooperates with the cam 8′ at the base plate 6 to form a shift block or entry protection for the window or door, as can be seen in FIG. 3.

Before reaching the medium tilting angle of about 7° to 8° the latch pin 15 has, however, also moved underneath the cam 8″ of the base plate 6 (see FIG. 3). The latch pin 15 remains there also during the further tilting-opening movement of the wing 2 until the maximal tilting angle of e.g. 15° in the effective range of the cam 8″ has been reached to form a shift block or entry protection for the window or door for this maximum tilting angle.

In this way, the connecting rod hardware of the pivot-hung tilt-window or door is provided with a double shift block or entry protection. This is done in such a way, that the effective ranges of these two shift blocks or entry protections partially overlap and assure, thereby, a high degree of security against unauthorized entry of the window or door when the wing is tilted. In the closed position of the wing 2, the latch-pin 15 naturally interacts in the usual manner with the latch-catch 7 at the base plate 6 and presses the lock-side (lower corner of wing 2) against the corresponding corner of the stationary frame. To allow the contact pressure to be regulated in order to achieve a satisfactory sealing effect, it is advantageous to rivet the latch-pin 15 around an eccentric axis on the slide plate 11, so that it can be rotated only with difficulty. By means of a tool, sch as a hexagon socket wrench, the closing effect of the latch-pin 15 can then be adjusted within a certain limit.

For the rotary opening of wing 2, the slide plate 11 is so adjusted by means of the interconnected rod hardware that the latch-lug 13 is situated (on the one hand) outside of the latch pocket 5′ or 5″ while still underneath the cam 8″ or 8′ lying nearest to it, while (on the other hand) the latch-pin 15 is set in each case in the range of the gap 19″ or 19′ between the latch catch 7 and the cam 8″ or 8′. In this position of shift, the stop 17 of the slide is simultaneously at sufficient distance above the cam 8′ or 8″ that the wing 2 can be freely opened in rotary mode relative to the stationary frame 1.

In conclusion, the oppositely-staggered, but partly overlapping effective ranges of the two shift blocks or entry protections are essentially based on the fact that these shift blocks or entry protections on two different effective radii 20 and 21 relative to the selected tip axis for the wing 2. In that way, the shift block or entry protection that operates with the greater effective radius 20 becomes chronologically active earlier than the one that operates with the smaller effective radius 21.

Tip-latch lock-hardware of the design claimed and described is used in connection with pivot-hung tilting windows and doors where it is important to achieve an effficient and economical execution of the stop operation for the hardware and fittings and to assure thereby an optimal effect of the shift block or entry protection independently of the specific wing level.

It is obvious that minor changes may be made in the form and construction of the invention without departing from the material spirit thereof. It is not, however, desired to confine the invention to the exact form herein shown and described, but is is desired to include all such as properly come within the scope claimed.

The invention having been thus described, what is claimed as new and desired to secure by Letters Patent is:

1. Tip-latch lock hardware for tip-wing pivot-hung casement windows and doors, comprising a latch-pocket disposed at the locking side of the bottom corner of a stationary frame, into which extends a latch-lug at the bottom end of a slide plate at the side of the wing for the purpose of opening the window by tilting, a latch-pin extending from the connecting rod at some distance above the latch-lug for engaging in the closed position of the wing, a latch-catch at the side of the frame lug with a transverse shoulder, located about and spaced from the latch-pin, projecting from the side plate in the direction of the plane of the wing and transversely of the direction of thrust of the side plate to said shoulder, a first stationary cam lying above the latch-pocket and the latch-catch at the stationary frame offset to the longitudinal median plane of the latch-pocket towards the side of the room, said cam being positively undercut by the shoulder in the tipped position of the window wing, characterized by the fact that, a second stationary cam is located below the latch-catch, and lies offset from the longitudinal median plane of the latch-pocket towards the side of the room at the stationary frame which lies in the tipping postion of the wing above the latch-pin, a shoulder being positioned in locking relationship beneath said first cam for small to medium angular positions of the wing, while the latch-pin is positioned in locking relationship beneath said second cam for medium to large angular positions of the wing.

2. Tip-latch lock hardware as set forth in claim 1, characterized by the fact that, the latch-catch and said first and second cams sit on a common base plate, wherein the cams are arranged on the base plate symmetrical to a transverse plane which passes through the latch-catch, while the latch-pockets are situated in a second base plate which is likewise shaped symmetrical to a transverse plane.

3. Tip-latch lock hardware as set forth in claim 1, characterized by the fact that, the distance between the lug which forms the transverse shoulder of the slide plate and the latch-pin is substantially greater than the distance of the latch-pin from the latch-lug of the slide plate.

4. Tip-latch lock hardware as set forth in claim 1, characterized by the fact that, the latch-lug, the latch-pin, and the lug which forms the transverse shoulder are arranged on a common longitudinal median plane of the slide plate and that all parts are designed symmetrical to this longitudinal median plane.

5. Latch lock hardware for casement windows having a pivoting latch-lug for insertion into a latch-pocket at the bottom of the window casing for the purpose of opening the window by tilting about the latch-pocket, said latch lock hardware comprising:

(a) a first stationary cam located on the window casing above the latch-pocket, (b) a second stationary cam located on the window casing between the first stationary cam and latch-pocket, (c) a lug mounted on the window above the latch-pin said lug remaining below said first cam and above said second cam during pivoting of the window about the latch-pocket, said latch-lug being in alignment with said first cam to prevent removal of the lug from the pocket when the window is tilted from the closed postion to a first maximum tilting angle position, and (d) a latch-pin mounted on the window above the pivoting lug and which remains below said first cam during pivoting of the window about the pocket, said latch-pin being in alignment with said second cam to prevent removal of the lug from the latch-pocket when the window is tilted from said first maximum tilting angle position to a second maximum angle position.

* * * * *